United States Patent [19]

Ashbeck

[11] Patent Number: 4,541,117

[45] Date of Patent: Sep. 10, 1985

[54] SEALING CLOSURE FOR A FLEXIBLE CONTAINER

[75] Inventor: Robert M. Ashbeck, Bakersfield, Calif.

[73] Assignees: Martin I. Davis, Bakersfield; Kenneth M. Dewing, Porterville, both of Calif. ; part interest to each

[21] Appl. No.: 518,299

[22] Filed: Jul. 28, 1983

[51] Int. Cl.[3] ..... B65D 33/00

[52] U.S. Cl. ..... 383/64; 383/13; 220/80

[58] Field of Search ..... 383/64, 65, 13; 24/587; 220/80

[56] References Cited

U.S. PATENT DOCUMENTS

| | | | |
|---|---|---|---|
| 1,371,934 | 3/1921 | Reynolds | 383/33 |
| 1,781,448 | 11/1930 | Dunnican | 220/80 |
| 2,514,750 | 7/1950 | Dobbs et al. | 383/64 |
| 3,026,017 | 3/1962 | Hopkins | 383/13 |
| 3,173,184 | 3/1965 | Ausnit | 383/64 |

*Primary Examiner*—Stephen Marcus
*Assistant Examiner*—David Voorhees
*Attorney, Agent, or Firm*—Thoms M. Freiburger

[57] ABSTRACT

A sliding closure device for flexible plastic containers provides a strong closure with an effective vapor and moisture barrier, still allowing the container to be collapsible.

2 Claims, 5 Drawing Figures

10
11
12
13
14
16
17
18
19
20
21
22
23
24
26
27
28
30
31
32
3

SEALING CLOSURE FOR A FLEXIBLE CONTAINER

BACKGROUND OF THE INVENTION

The invention relates to containers, and more particularly to a slidable closure device for flexible plastic containers, for effecting a sealed closure.

Flexible containers for retaining moisture, such as for storage of foods, are well known. For example, there have been marketed flexible plastic bag-like containers closed on three edges and having a fourth or top side wherein the two flaps may be sealed together in zipper-like fashion, one flap having a groove and the other a ridge. Pressure applied along the length of this prior-art closure device forces the ridge into the groove to create a seal which is often vapor and water-tight. An example of such construction is a container marketed under the name Ziploc by Dow Chemical Co. and shown in U.S. Pat. No. Re. 28,969. However, such closure seals are rather difficult to close, are easily opened with relatively small pulling-apart force, so that inadvertent opening is likely, and usually become ineffective and useless after a number of repeated uses. In addition, such closures have not included any carrying handle for situations where it would be needed or desirable.

There has been a need for a versatile flexible container closure which is re-usable for a large number of uses, which effects a complete moisture and liquid-tight seal, which is easy to use, and which includes a convenient carrying handle. These objects are efficiently met with the present invention described below.

SUMMARY OF THE INVENTION

A container closure according to the present invention provides a liquid and moisture tight seal on a flexible bag-like container having three closed edges and an open mouth. The closure includes a pair of sealing lips, one bonded to each flap of the container mouth and each being continuous along the flap and formed of resilient material for effecting a seal when the lips are together. An elongated slidable closure strip which cooperates with the sealing lips has a pair of depending flanges spaced apart and positioned to compress the lips together along their full length when the closure strip is slid longitudinally over the lips.

In a preferred embodiment, the closure strip is a rigid channel-shaped member having an extension acting as a handle for carrying the empty or loaded container. The channel may have an outwardly flared front end to help it advance over the sealing lips. On one of the lips there may be included one or more raised ridges, continuous through the length of the lip, for compressing against the inside surface of the opposite lip when the closure strip holds the lips together, to provide a better seal. The lips may be pre-configured to bow outwardly when the closure strip is not in place, to hold the container mouth open.

By this configuration the container closure of the invention enables a secure vapor and liquid tight seal, with convenience and efficiency in use, handling and storage. Other objects, advantages, features and characteristics of the invention will be apparent from the following description of a preferred embodiment, considered along with the accompanying drawings.

DESCRIPTION OF THE EMBODIMENT

Figures 1, 2, 3, 4, 5:
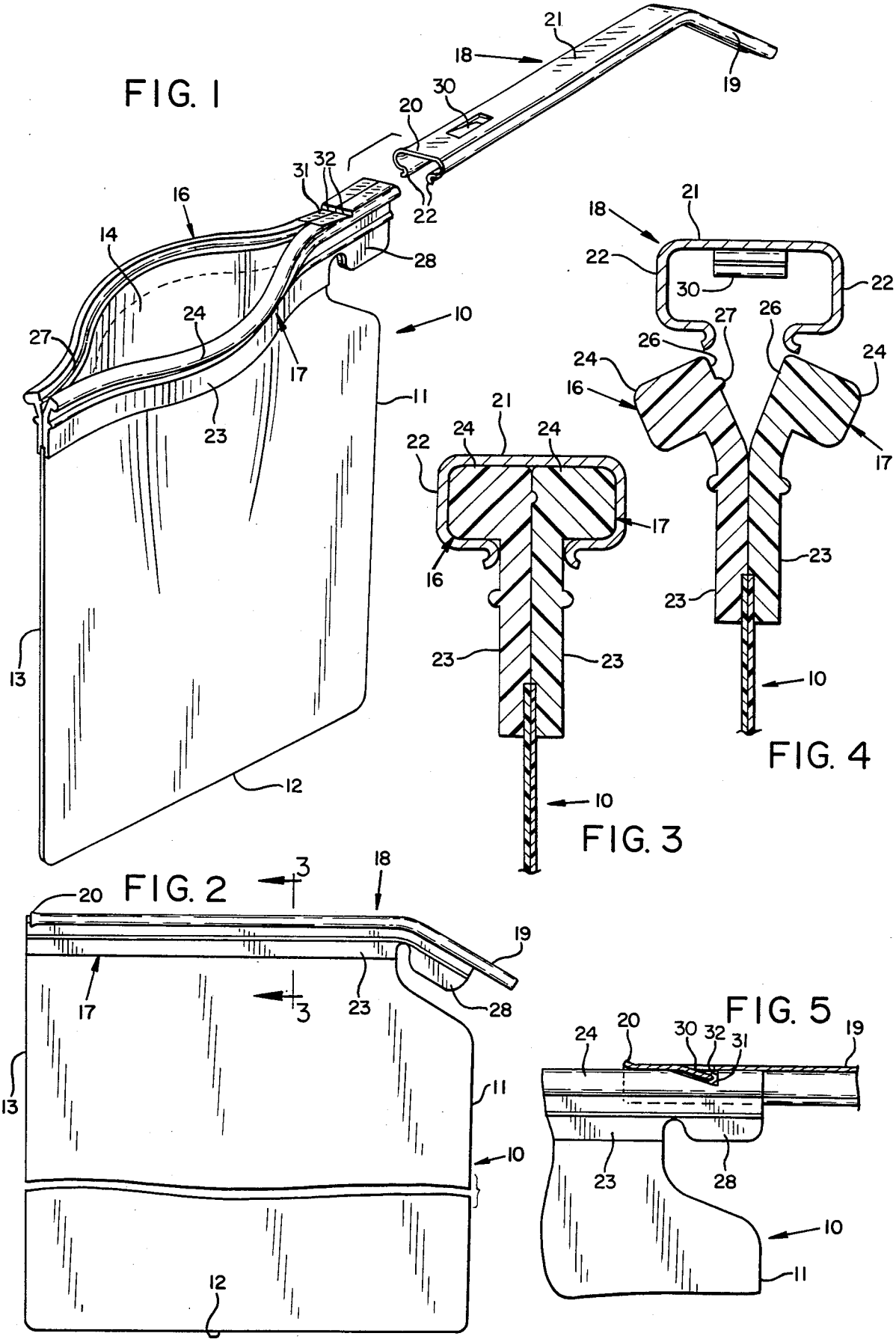
FIG. 1 is a perspective view of a container with a sealable closure according to the invention, shown open, with sealing lips preformed to bow outwardly and hold the mouth of the container open.
FIG. 2 is a side view of the container and closure.
FIG. 3 is a sectional view taken along the line 3—3 in FIG. 2, showing the closure in closed, sealing configuration as in FIG. 2.
FIG. 4 is a sectional view similar to FIG. 3 but showing the closure with the sealing lips adjacent, but not compressed together by a closure strip, which is shown above.
FIG. 5 is a fragmentary side view, partially in section, showing a locking detent arrangement for holding the closure strip on the sealing lips.

In the drawings, FIGS. 1 through 5 illustrate a portable, collapsible bag-like container 10 of any selected capacity with three closed sides or edges 11, 12 and 13 and an open top or mouth 14. The mouth 14 has resilient sealing lips 16 and 17 which preferably are preformed to resiliently bow outwardly as shown, to normally hold the mouth 14 in the open position.

The container 10 is formed of any suitable flexible water-impervious and moisture-imprevious material, preferably a plastic film, and is bonded at its upper edges, at the open top 14, to the sealing lips 16 and 17 such that a complete sealed enclosure is formed when the lips 16 and 17 are compressed together. The bonding may be by heat sealing or other appropriate means.

A closure strip 18, which preferably includes a handle 19 extending as shown, preferably as a continuous member, is adapted to slide over the two lips 16 and 17 to compress them together into sealing relationship. As shown in FIGS. 1, 3 and 4, the strip 18 may comprise a channel-shaped member with a generally flat center section 21 and a pair of spaced flanges 22, shaped complementarily to the outside surfaces of the lips 16, 17, which preferably are arcuate or otherwise rounded, as shown. The closure strip 18 is relatively rigid, formed preferably as an extrusion of rigid plastic or metal. It includes a flared-out or curved forward end 20, where the flanges 22 diverge (not shown in detail), for helping guide the lips 16 and 17 into the channel where they are compressed together.

The lips 16 and 17 are of an elastomeric, compressible material that will seal against moisture and vapor and that will bond well to the material of the container. Each lip includes a lower, container mouth reinforcing portion 23, integrally formed with the upper sealing portion 24 as indicated. The lower portion 23 is bonded at its inner or outer surface to the adjacent flap or edge of the container mouth 14 (shown bonded at the innder surface). The lips 16 and 17, in their relaxed configuration is formed, preferably each have an inclined generally planar innner surface 26 of the sealing portion 24, forming a V-shaped notch as shown in FIG. 4 when the lips are adjacent but not compressed together. One of the lips, such as the lip 16 shown in FIG. 4, may include one or more raised ridges 27 integrally formed with the lip on its inclined surface 26, for improving the seal made when the two surfaces 26 are resiliently compressed together as shown in FIG. 3.

On the upper back of the container, preferably as an extension of the lips 16 and 17, there may be a gripping tab 28 for helping draw the lips into the closure strip 18. This is particularly useful in the case of small or light-weight containers for operating the closure with one hand, which is done by placing the end of the handle 19 against a bearing surface and drawing the closure lips into the closure strip by pulling on the tab 28.

The closure strip 18 should be retained on the sealing lips 16 and 17 so as to prevent its being pulled off the end of the lips when the container is opened. For this purpose, a rearward stop is provided. As shown in FIGS. 1 and 5, the strip 18 may include a locking detent 30 angled as shown and cooperative with a notch 31 providing an abutment 32 across the top of the lips 16, 17 at the rear where they are bound together. The detent 30 freely slides over the lips 16, 17, in both directions, but it is lightly biased downward toward the position shown in FIG. 5 and it thereby prevents the handle from being retracted beyond its position of FIG. 5.

The seal of the invention can be produced in any size appropriate to the capacity of the finished container, and will provide strength appropriate to the strength of the container material. The flexible container can be rolled or folded when empty, thereby providing minimum bulk and weight, including the closure sealing device.

The container and closure device produce a barrier to vapor, odor, fumes, air, fluids and moisture, and will protect against light if opaque plastics are used. Noxious or toxic materials, either acid or alkaline, can be contained dependent on choice of materials used in the seal and container.

The container and closure of the invention can also be used for shipment, handling and storage of parts or equipment, sub-assemblies, raw materials and other solid items that would be adversely affected by exposure.

The preferred embodiment described herein is intended to be purely illustrative, and not limiting of the scope of the invention. Other embodiments and variations will be apparent to those skilled in the art and may be made without departing from the essence and scope of the invention as defined in the following claims.

I claim:

1. A closable and re-openable flexible container capable of forming a liquid and vapor tight seal, comprising:

a bag-like container formed of flexible film material, closed at a bottom edge and two side edges and open at a top comprising two top edges;

a pair of sealing lips bonded to the top edges of the container, continuous along the edges, the lips being formed of resilient material and being preformed in an outwardly bowed configuration to normally resiliently bow outwardly to hold the container top open, for aiding in putting material into the container, one of the sealing lips having an inside surface with at least one raised ridge continuous through the length of the lip, the opposite lip having a generally flat mating inside surface free of recesses to avoid contamination by substances stored in the container, the raised ridge being positioned to be compressed against and depressed into the opposite flat lip surface when the closure strip is advanced toward the closed position, to provide a better seal;

a slidable, generally channel-shaped, relatively rigid closure strip having a pair of depending flanges spaced apart and positioned to compress the resilient lips together along their full length when the closure strip is advanced longitudinally over the lips, the flanges being shaped generally complementarily to the exterior of the lips for gripping retention thereon, and the closure strip including a handle portion extending from one end; and a grip comprising a pull tab formed integrally with the sealing lips and extending from one end thereof, for enabling a user to pull the sealing lips slideably into the closure strip.

2. The container of claim 1, further including a stop associated with the closure strip and the lips for preventing the closure strip from sliding off the lips when it is retracted to a position wherein the container is opened, the stop comprising a springable detent extending downwardly in the closure strip and a notch in the top of the sealing lips having an abutment against which the detent engages when the closure strip is retracted to the position wherein the container is open.

* * * * *